US011412848B2

(12) United States Patent
Samikkannu et al.

(10) Patent No.: US 11,412,848 B2
(45) **Date of Patent: *Aug. 16, 2022**

(54) TABLE WITH SWINGABLE STOOLS

(71) Applicant: AMTAB MANUFACTURING CORPORATION, Bensenville, IL (US)

(72) Inventors: Doss Samikkannu, Bensenville, IL (US); Gregory Rajkiewicz, Bensenville, IL (US); Jeremias C. Rivera, Jr., Bensenville, IL (US)

(73) Assignee: AMTAB MANUFACTURING CORPORATION, Bensenville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/184,424

(22) Filed: Feb. 24, 2021

(65) Prior Publication Data

US 2021/0177141 A1 Jun. 17, 2021

Related U.S. Application Data

(63) Continuation of application No. 16/554,998, filed on Aug. 29, 2019, now Pat. No. 10,939,757.

(51) Int. Cl.
*A47C 9/02* (2006.01)
*A47B 83/02* (2006.01)

(52) U.S. Cl.
CPC ..... *A47B 83/0213* (2017.08); *A47C 9/022* (2013.01)

(58) Field of Classification Search
CPC ..... A47B 83/0213; A47C 9/022
See application file for complete search history.

(56) References Cited

U.S. PATENT DOCUMENTS

| | | | | |
|---|---|---|---|---|
| 283,512 | A | 8/1883 | Reynolds | |
| 624,869 | A | 5/1899 | Rudy | |
| 1,344,940 | A | 6/1920 | Gavin | |
| 1,652,100 | A | 12/1927 | Eastburn | |
| 1,688,415 | A | 10/1928 | Fox | |
| 1,944,765 | A | 1/1934 | Sheldon | |
| 2,024,045 | A | 12/1935 | Johnson | |
| 2,306,812 | A | 12/1942 | Ketive | |
| 2,782,837 | A | 2/1957 | Munsch | |
| 10,278,495 | B2 | 5/2019 | Byrne et al. | |
| 10,939,757 | B1 * | 3/2021 | Samikkannu | A47C 9/022 |

OTHER PUBLICATIONS

U.S. Appl. No. 16/554,998, filed Aug. 29, 2019.

(Continued)

*Primary Examiner* — Philip F Gabler
(74) *Attorney, Agent, or Firm* — Barnes & Thornburg LLP

(57) ABSTRACT

A table includes a frame, a table top coupled to an upper portion of the frame, and a plurality of stools coupled to legs of the frame. The stools are swingable relative to the frame from a retracted-storage position to an extended use-position. The stools are arranged to engage with a surface beneath the table in the extended-use position to support a user of the table relative to the table top. The stools are arranged substantially within a perimeter of the table top in the retracted-storage position for access around the table.

15 Claims, 6 Drawing Sheets

(56) References Cited

OTHER PUBLICATIONS

1stdibs, "All Original Milk Glass and Iron Swivel Stool Industrial Factory Table," accessed on-line at: https://www.1stdibs.com/furniture/tables/industrial-work-tables/all-original-milk-glass-iron-swivel-stool-industrial-factory-table/id-f_11092743 (accessed on Jan. 11, 2019.
1stdibs, "Cast Iron Swing Swivel Stool Industrial Factory Table with Four Stools," accessed on-line at: https://www.1stdibs.com/furniture/tables/industrial-work-tables/cast-iron-swing-swivel-stool-industrial-factory-table-four-stools/id-f_6162353 (accessed on Jan. 11, 2019).
Get Back Inc., "Industrial Swing-out-seat Restaurant Dining Table," accessed on-line at: https://getbackinc.com/product/communal-dining-table (accessed on Jan. 11, 2019).
Get Back Inc., "Swing Out 6-Seat Dining Table Cast Iron & Wood, with Metal Top," accessed on-line at: https://web.archive.org/web/20170921184130/http://www.getbackinc.com (accessed on Jan. 11, 2019).
OFM, "Model 9004 Endure Standing Height Table with Seats," Brochure (Jul. 2018).
OFM, "Model 9244 Endure Student Table," Brochure (Mar. 2018).
OFM, "Model 9294 Endure Student Table," Brochure (Mar. 2018).
Palmer Hamilton, "The Rally Table," Brochure (available prior to the filing of the present application).

* cited by examiner

TABLE WITH SWINGABLE STOOLS

CROSS REFERENCE TO RELATED APPLICATIONS

This application is a Continuation of U.S. application Ser. No. 16/554,998, filed Aug. 29, 2019, now issued as U.S. Pat. No. 10,939,757. The disclosure set forth in the referenced application is incorporated herein by reference in its entirety.

BACKGROUND

The present disclosure relates to a table, and particularly to a table with attached stools. More particularly, the present disclosure relates to a table with attached stools that are swingable between a retracted-storage position and an extended-use position.

SUMMARY

According to an aspect of the present disclosure, a table includes a frame, a table top coupled to an upper portion of the frame, and a plurality of stools coupled to legs of the frame. The stools are swingable relative to the frame from a retracted-storage position to an extended use-position. The stools are arranged to engage with a surface beneath the table in the extended-use position to support a user of the table relative to the table top.

In illustrative embodiments, the stool is arranged at a first height above the surface in the retracted-storage position and the stool is arranged at a second height above the surface in the extended-use position, and the second height is less than the first height.

In illustrative embodiments, the stool includes a hinge and a seat. A first end of the hinge is coupled to the frame and the seat is coupled to a second end of the hinge spaced apart from the first end. The hinge is configured to allow movement of the seat relative to the frame, and the seat is configured for movement toward and away from the surface relative to the hinge.

In illustrative embodiments, in the extended-use position, the seat is configured to engage with the surface in response to a user sitting on the seat to support the user relative to the table top.

In illustrative embodiments, the frame includes a leg and a cross-brace coupled to the leg. The first end of the hinge is coupled to the leg, and the hinge is configured to engage with the cross-brace to support the stool in the retracted-storage position.

In illustrative embodiments, the hinge includes a base tube arranged at the first end of the hinge, a swing tube arranged at the second end of the hinge, and an arm coupled between the base tube and the swing tube. The seat extends into the swing tube, and the base tube is coupled to the leg and configured to allow pivoting and sliding movement of the hinge relative to the frame.

In illustrative embodiments, a shaft extends through the base tube and is coupled to the leg to support the hinge on the frame.

In illustrative embodiments, the base tube is configured to pivot around the shaft and to slide along the shaft.

In illustrative embodiments, a biasing element is coupled to the seat and to the hinge. The seat is configured to slide along the swing tube of the hinge, and the biasing element is configured to bias the seat away from the surface.

In illustrative embodiments, the biasing element is a gas cylinder.

According to another aspect of the present disclosure, a table includes a frame having a plurality of legs, a table top coupled to the frame for supporting the table top above a surface, and a plurality of stools coupled to the plurality of legs of the frame. Each stool of the plurality of stools is configured for movement relative to the frame between a retracted-storage position and an extended-use position. The plurality of stools are arranged at a first height above the surface in the retracted-storage position and the plurality of stools are arranged at a second height above the surface in the extended-use position, and the second height is less than the first height.

In illustrative embodiments, each stool in the plurality of stools includes a hinge and a seat. A first end of the hinge is coupled to the frame, and the seat is coupled to a second end of the hinge spaced apart from the first end. The hinge is configured to allow movement of the seat relative to the frame. The seat is configured for movement toward and away from the surface relative to the hinge.

In illustrative embodiments, in the extended-use position, the seat is configured to engage with the surface in response to a user sitting on the seat to support the user relative to the table top.

In illustrative embodiments, a cross-brace is coupled to the plurality of legs of the frame. The hinges of the stools in the plurality of stools are coupled to the plurality of legs, and the hinges are configured to engage with the cross-brace to support the corresponding stool of the plurality of stool in the retracted-storage position.

In illustrative embodiments, each hinge includes a base tube arranged at the first end of the hinge, a swing tube arranged at the second end of the hinge, and an arm coupled between the base tube and the swing tube. The seats extend into the swing tubes, and the base tubes are coupled to the plurality of legs and configured to allow pivoting and sliding movement of the hinges relative to the frame.

In illustrative embodiments, shafts extend through the base tubes and are coupled to the plurality of legs to support the hinges on the frame.

In illustrative embodiments, the base tube is configured to pivot around the shaft and to slide along the shaft.

In illustrative embodiments, biasing elements are coupled to the seats and the hinges. The seats are configured to slide along the swing tubes of the respective hinges, and the biasing elements are configured to bias the seats away from the surface.

In illustrative embodiments, each biasing element is a gas cylinder.

In illustrative embodiments, at least two stools of the plurality of stools are coupled to the same leg of the plurality of legs.

According to another aspect of the present disclosure, a table includes a frame having a leg and a cross-brace, a table top coupled to the frame for supporting the table top above a surface, and a stool having a hinge and a seat. The hinge is coupled to the leg and the seat is coupled to the hinge. The hinge is configured to allow movement of the seat relative to the frame between a retracted-storage position and an extended-use position. The seat is arranged at a first height above the surface in the retracted-storage position and the seat is arranged at a second height above the surface in the extended-use position, and the second height is less than the first height. The seat moves away from the table top and toward the surface with movement of the seat from the retracted-storage position to the extended-use position, and the hinge engages with the cross-brace to support the stool in the retracted-storage position.

Other aspects and advantages of the present disclosure will become apparent upon consideration of the following detailed description and the attached drawings wherein like numerals designate like structures throughout the specification.

BRIEF DESCRIPTIONS OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

Figure 5:
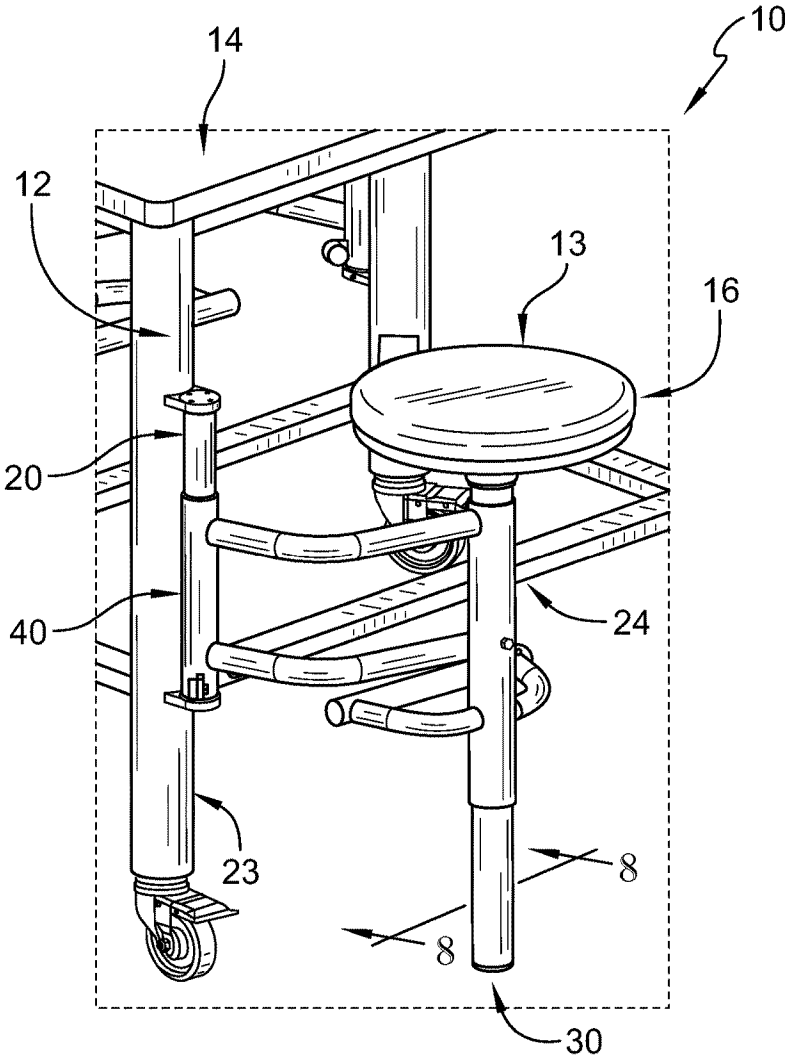
FIG. 5 is a view similar to FIG. 4 showing one of the stools in the extended-use position.
Figure 7:
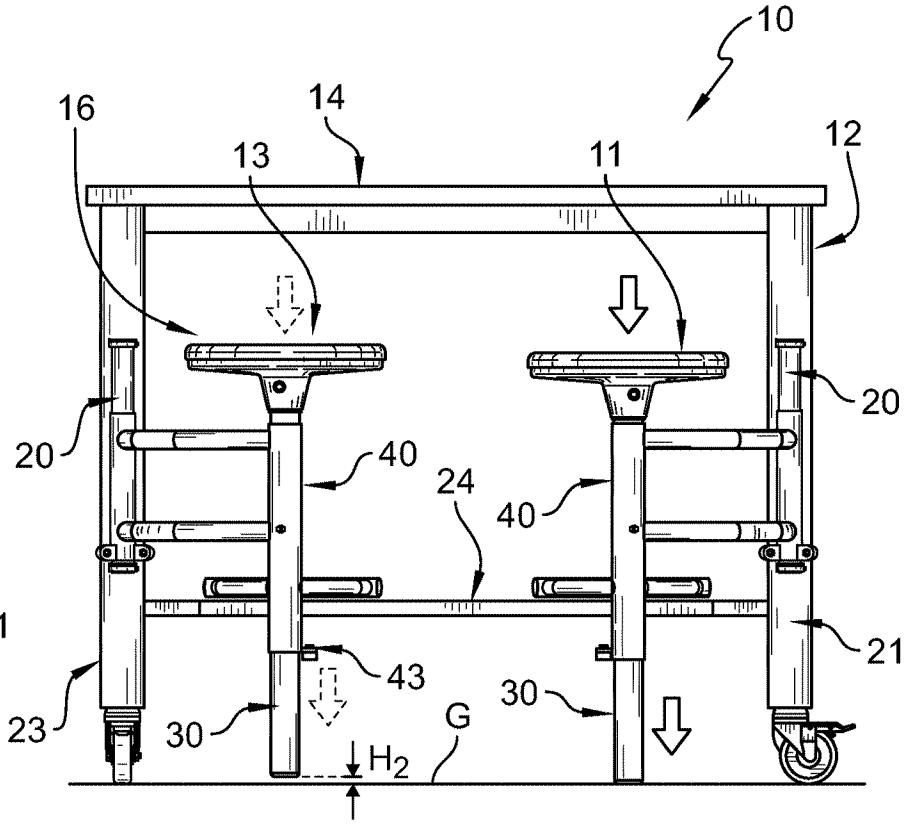
Figure 6:
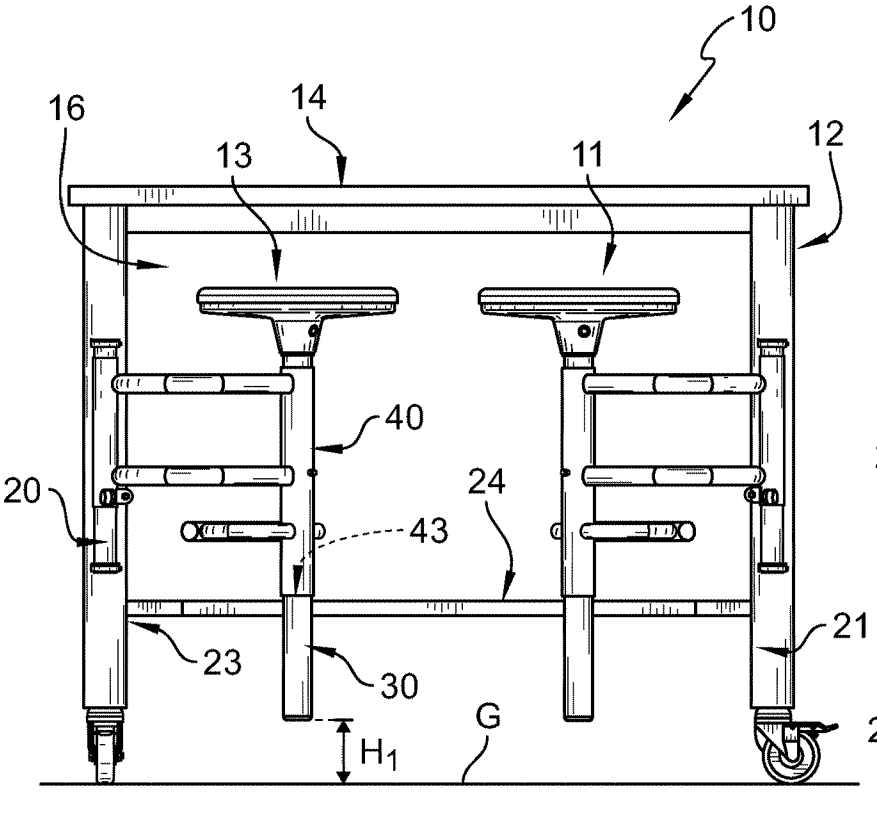
FIG. 6 is a side elevation view of the table of FIG. 1 showing the stools in the retracted-storage position and suggesting that the seat is arranged at a first height ($H_1$) relative to a surface under the table when the stool is in the retracted-storage position.
Figure 8:
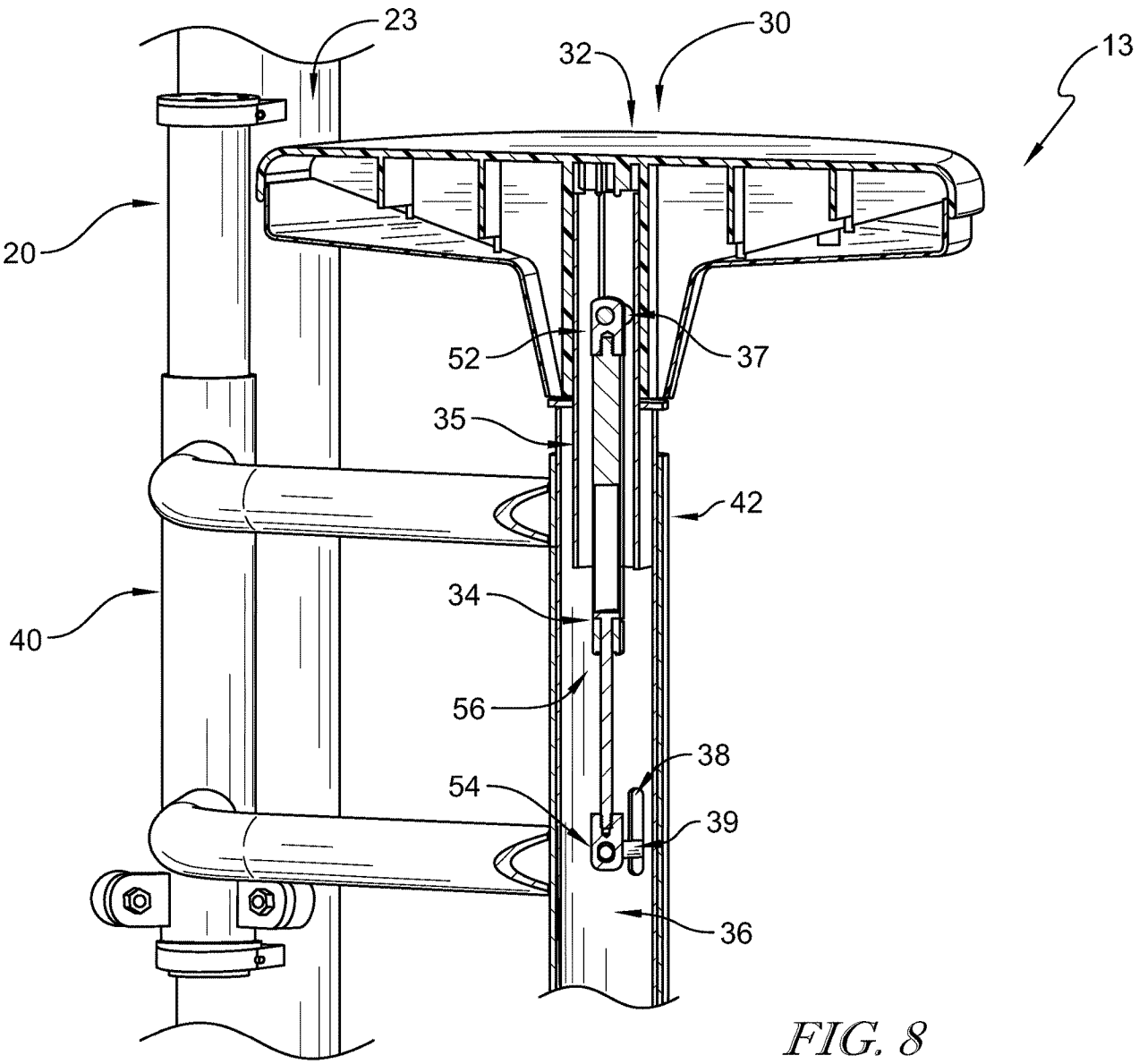
Figure 9:
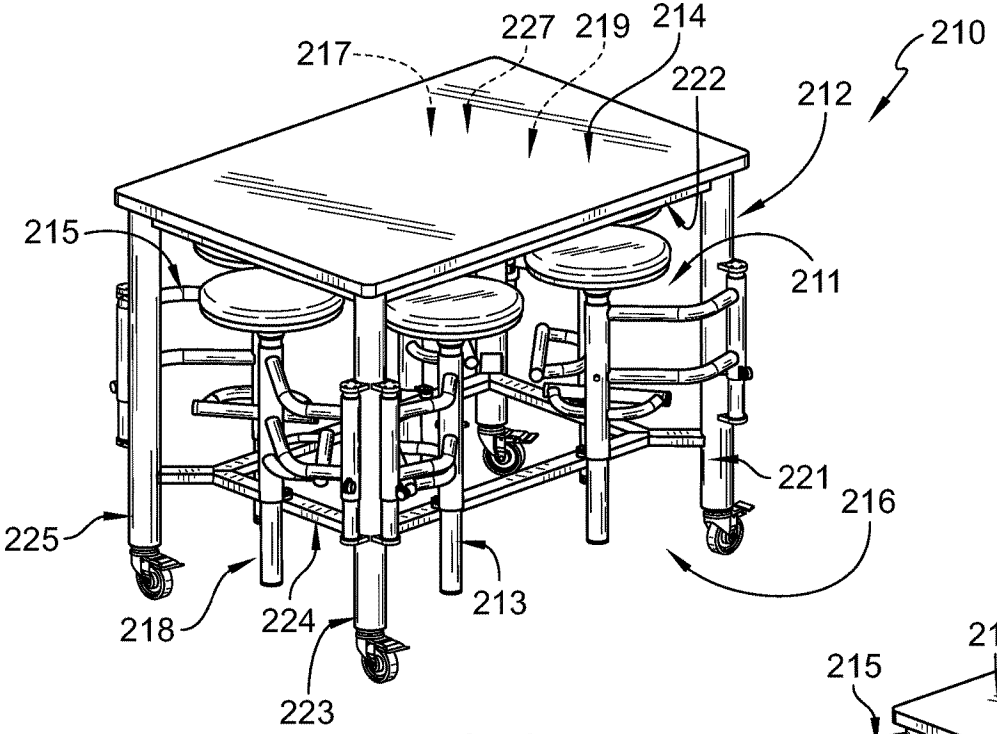
Figure 10:
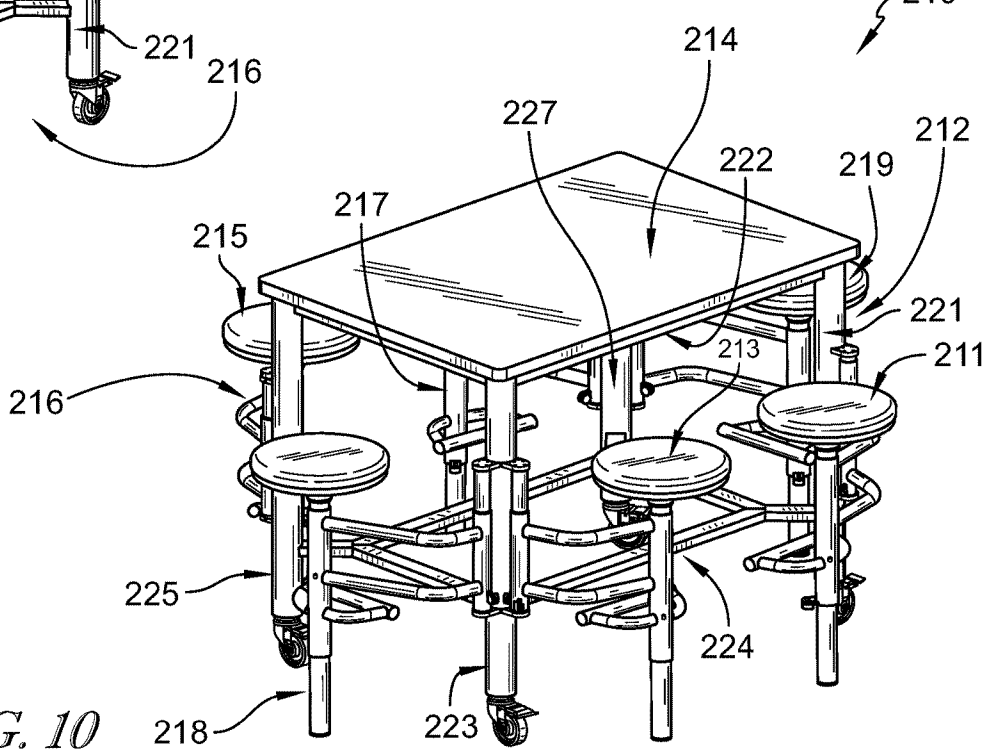

FIG. 7 is a view similar to FIG. 6 showing the stools in the extended-use position and suggesting that the seat is arranged at a second height ($H_2$) relative to the surface under when the stool is in the extended-use position and that the seat is movable relative to the hinge to engage the seat with the surface in response to a user sitting on the seat for supporting the user relative to the table top;

FIG. 8 is a sectional view taken along line 8-8 in FIG. 5 showing that the seat includes a seat pad coupled to a post and suggesting that a cylinder coupled to the seat pad and the hinge biases the seat upward away from the surface;

FIG. 9 is a perspective view of another embodiment of a table in accordance with the present disclosure showing that the table includes a frame, a table top coupled to an upper portion of the frame, and a plurality of stools coupled to legs of the frame and suggesting that the stools are in a retracted-storage position; and FIG. 10 is a view similar to FIG. 9 showing the stools moved to an extended-use position relative to the frame for supporting a user of the table relative to the table top.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Figure 1:
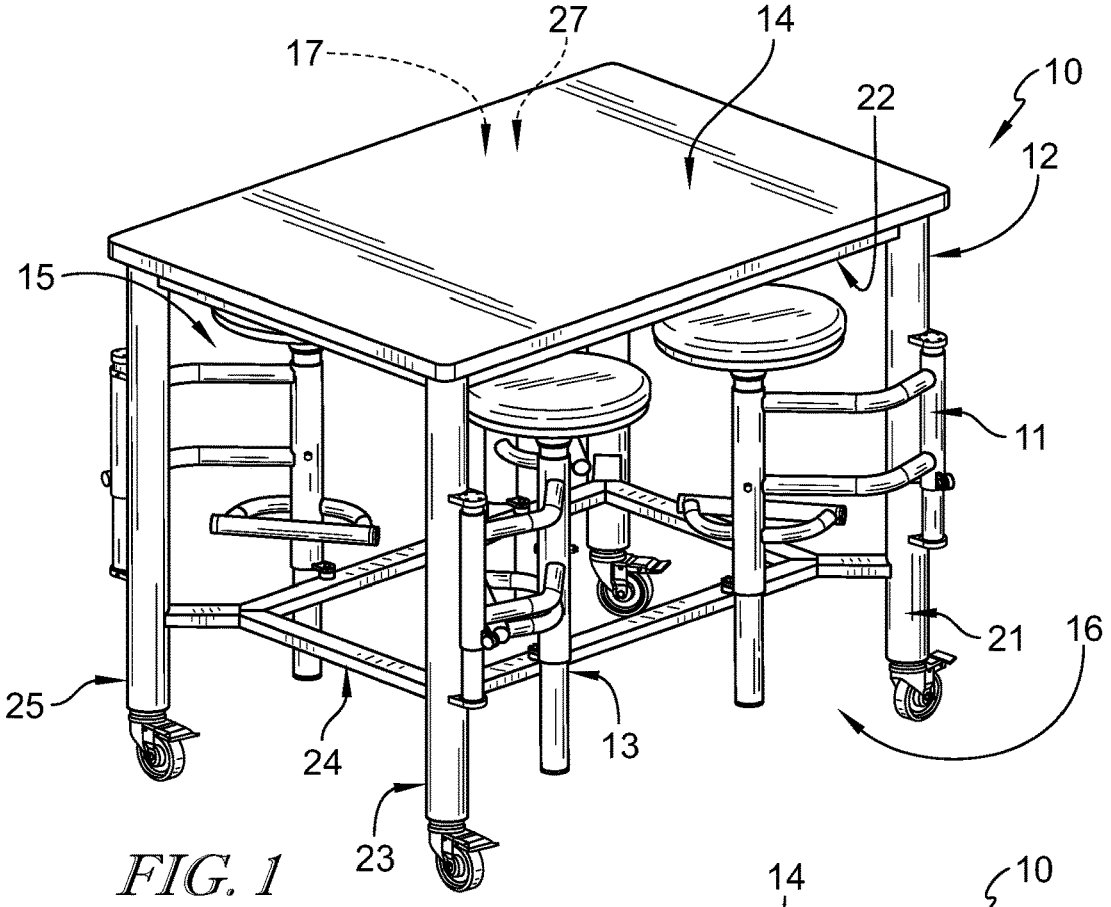
FIG. 1 is a perspective view of an embodiment of a table in accordance with the present disclosure showing that the table includes a frame, a table top coupled to an upper portion of the frame, and a plurality of stools coupled to legs of the frame and suggesting that the stools are in a retracted-storage position.

An illustrative embodiment of a table 10 in accordance with the present disclosure is shown in FIG. 1. The table includes a frame 12, a table top 14 coupled to an upper portion of the frame 12, and a plurality of stools 11, 13, 15, 17 coupled to the frame 12. The stools 11, 13, 15, 17 are coupled to legs 21, 23, 25, 27, respectively, of the frame 12 and move with the table 10 during repositioning of the table 10. The stools 11, 13, 15, 17 are movable relative to the frame 12 between a retracted-storage position, shown in FIGS. 1 and 4, and an expanded-use position, shown in FIGS. 2 and 5. The stools 11, 13, 15, 17 are raised above a surface G (e.g., the ground) supporting the table 10 in the retracted-storage position for access beneath the table 10 as suggested in FIG. 6. The stools 11, 13, 15, 17 are movable to the extended-use position, lower than the retracted-use position, and engage with the surface to support a user relative to the table top 14 as suggested in FIG. 7.

Figure 2:
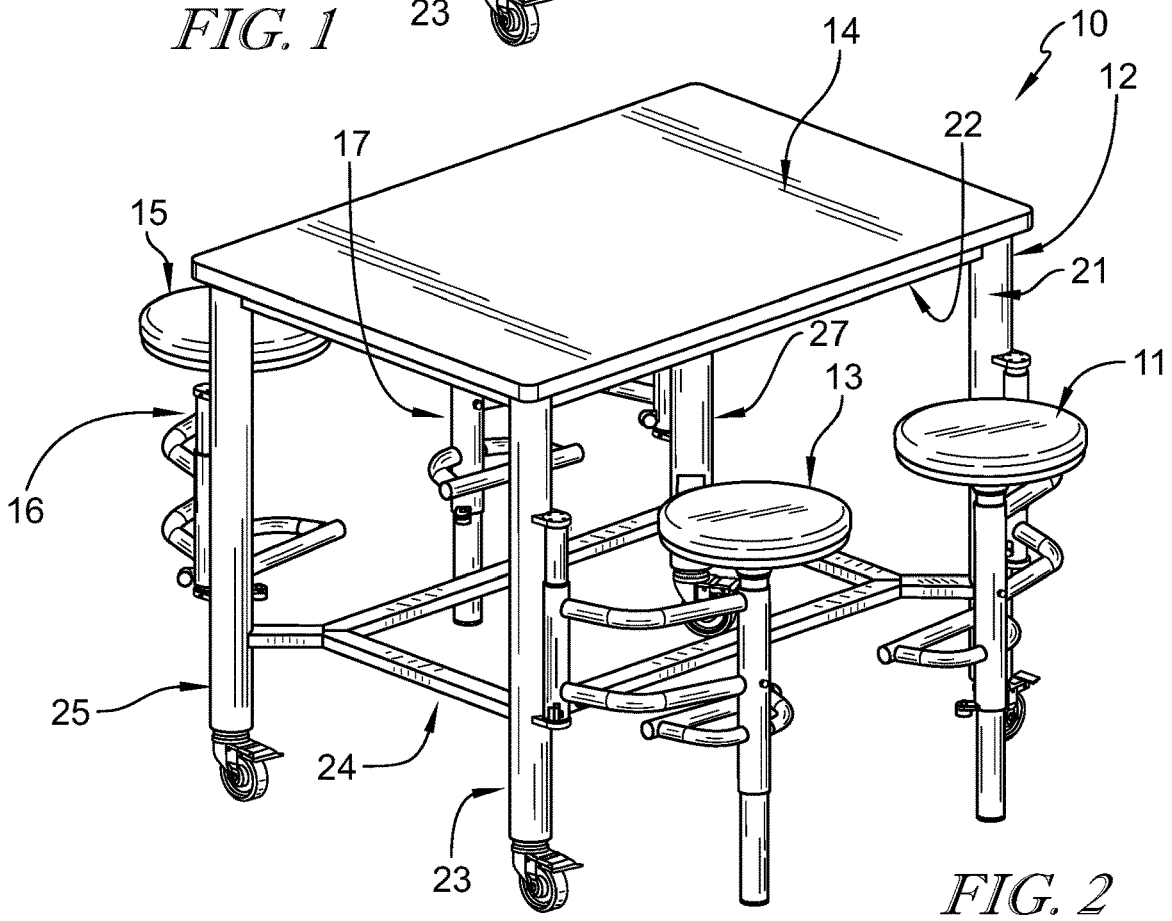
FIG. 2 is a view similar to FIG. 1 showing the stools moved to an extended-use position relative to the frame for supporting a user of the table relative to the table top.

The frame 12 includes the legs 21, 23, 25, 27, an upper cross-brace 22, and a lower cross-brace 24 as shown in FIGS. 1 and 2. The upper cross-brace 22 is coupled between the legs 21, 23, 25, 27 for supporting the table top 14. The lower cross-brace 24 is coupled between the legs 21, 23, 25, 27 and spaced apart from the upper cross-brace 22. In the illustrative embodiment, the legs 21, 23, 25, 27 are arranged in a rectangular pattern. In some embodiments, more or less legs can be used and arranged in other polygonal or non-polygonal shapes. In the illustrative embodiment, the table top 14 is shaped as a rectangle. In some embodiments, the table top 14 can assume other polygonal or non-polygonal shapes. In the illustrative embodiment, the stools 11, 13 are arranged along one side of the table 10 while the stools 15, 17 are arranged along an opposite side of the table 10. In some embodiments, the stools 11, 13, 15, 17 are arranged around the table 10, with one stool along each side, or in other patterns contemplated by the present disclosure.

Figure 3:
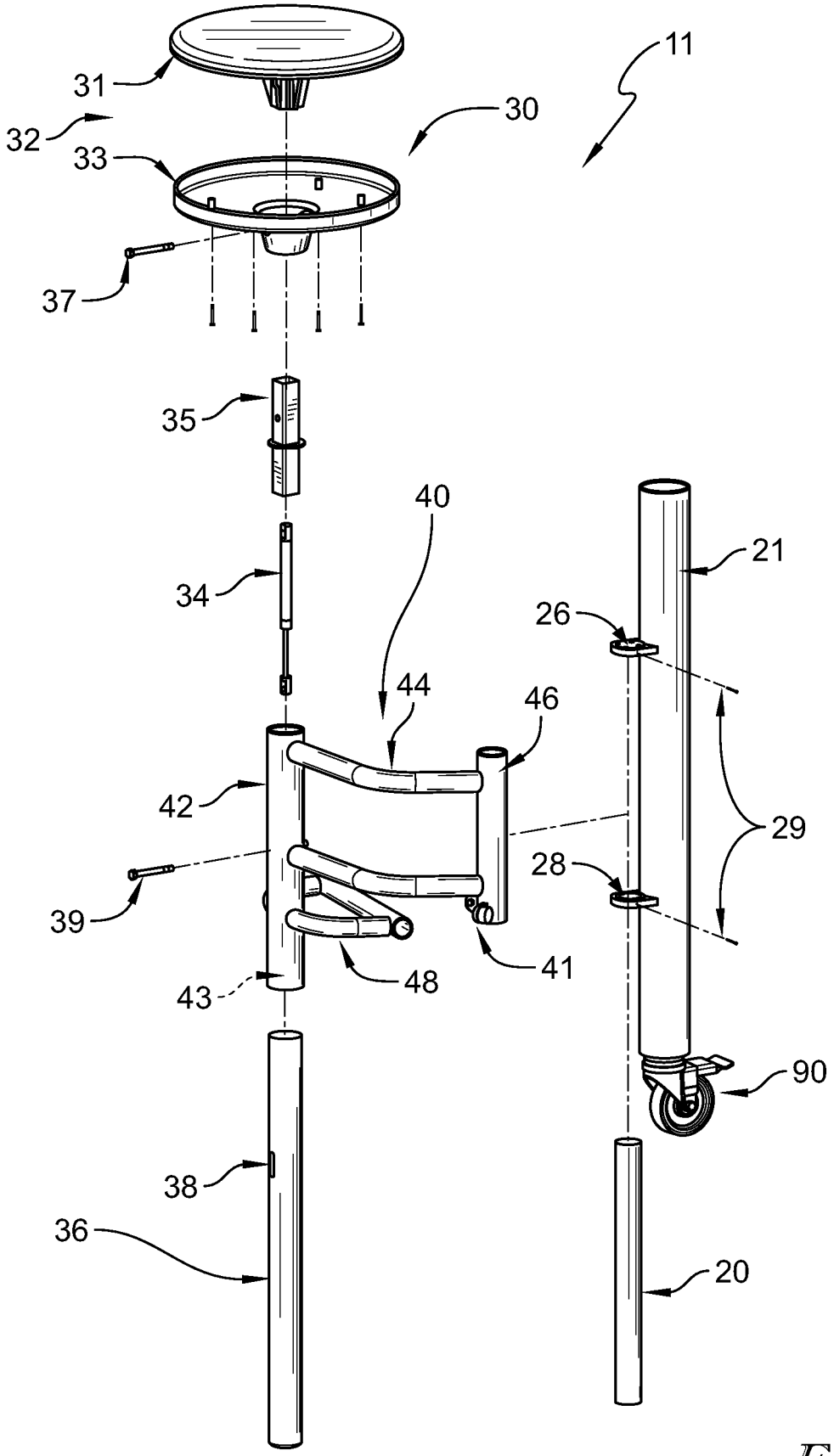
FIG. 3 is an exploded assembly view of one of the stools in FIG. 1 showing that the stool includes a hinge and a seat coupled to the hinge for movement with the hinge relative to the frame.

As illustrated by stool 11, each stool 11, 13, 15, 17 includes a seat 30 and a hinge 40 as shown in FIG. 3. Each arm 40 is coupled to one of the legs 21, 23, 25, 27 of the frame 12 by a shaft 20. The hinge 40 is configured to pivot around the shaft 20 and slide along the shaft 20 for movement of the stools 11, 13, 15, 17 between the retracted-storage and extended-use positions. The seat 30 is coupled to the hinge 40 for movement relative to the frame 12.

The seat 30 includes a seat pad 32 coupled to a post 36 as shown in FIG. 3. The hinge 40 includes a swing tube 42 coupled to a base tube 46 by one or more arms 44. The shaft 20 extends through the base tube 46 to hold the hinge 40 on the frame 12. The shaft 20 extends through sockets 26, 28 on the frame 12 and fasteners 29, such as rivets, extend through the sockets 26, 28 into the shaft 20 to hold the shaft 20 on the frame 12. The post 36 of the seat 30 extends through the swing tube 42 to support the seat pad 32 relative to the hinge 40. In the illustrative embodiment, the seat pad 32 includes an upper disk 31 and a lower disk 33 coupled to the upper disk 31. The exemplary seat pad 32 assumes a circular shape, but can assume other polygonal or non-polygonal shapes without departing from the present disclosure.

A gas cylinder 34 (sometimes called a lift piston or strut) is coupled between the hinge 40 and the seat pad 32 to bias the seat 30 relative to the hinge 40 as shown in FIG. 3. A fastener 39, such as a bolt, couples one end 54 of the gas cylinder 34 to the hinge 40 as suggested in FIGS. 3 and 8.

A slot 38 in the post 36 allows the seat to slide telescopically relative to the swing tube 42. A connector 35 is coupled to an upper end of the post 36. A fastener 37, such as a bolt, extends through the seat pad 32 and the connector 35 to hold the seat pad 32 on the post 36. The fastener 37 engages with an opposite end 52 of the gas cylinder 34 to couple the gas cylinder 34 with the seat pad 32. A biasing arrangement 56 couples the ends 52, 54 of the gas cylinder 34 and biases the ends 52, 54 away from one another. In some embodiments, another biasing element is used in place of or in addition to the gas cylinder 34, such as a spring. In some embodiments, a footrest 48 is coupled to the swing tube 42 as shown in FIG. 3. In some embodiments, one or more stops 41 are coupled to the base tube 46 and configured to engage with the frame 12 to limit pivoting movement of the stools 11, 13, 15, 17 relative to the frame 12. In some embodiments, rollers or casters 90 can be coupled to the frame 12 to support the table 10 for movement.

Figure 4:
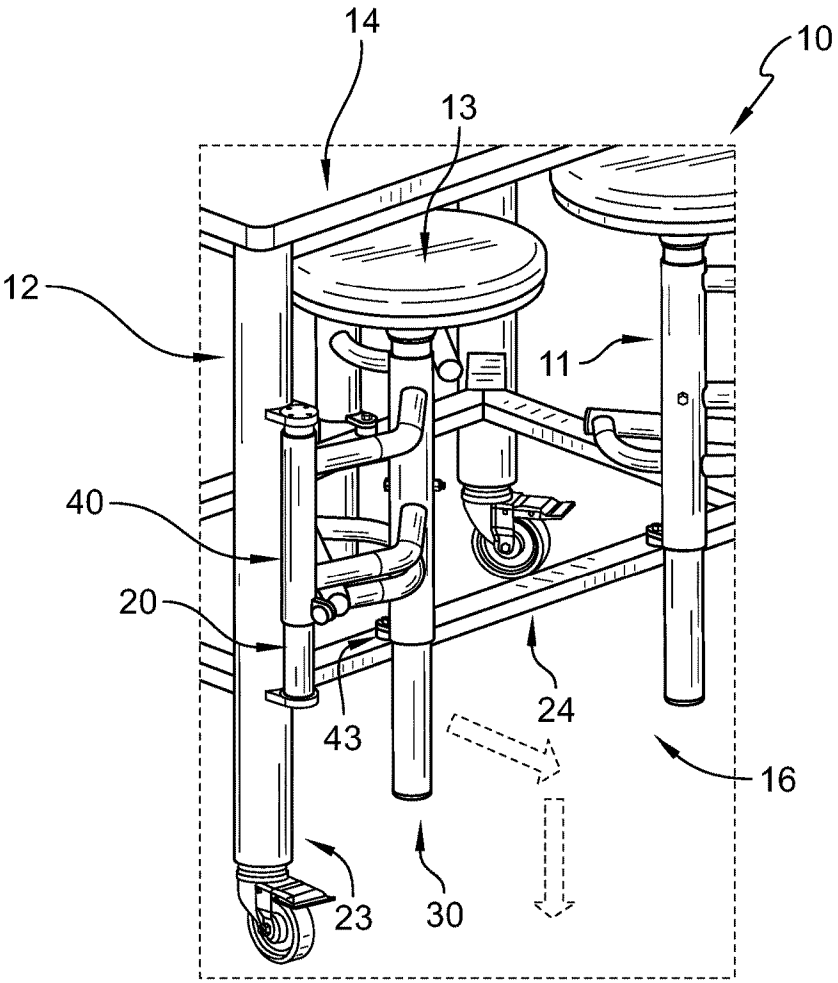
FIG. 4 is an enlarged view of FIG. 1 showing that tabs attached to the stools engage with a lower cross-brace of the frame to support the stools in the retracted-storage position and suggesting that the stools are move outward and downward from the retracted-storage position to the extended-use position, as shown in FIG. 5.

In the illustrative embodiment, a tab 43 is coupled to the swing tube 42 for supporting the stools 11, 13, 15, 17 in the retracted-storage position as suggested in FIGS. 3 and 4. The tabs 43 of the stools 11, 13, 15, 17 engage with the lower cross-brace 24 of the frame 12 to support the stools 11, 13, 15, 17 in the retracted-storage position as shown in FIG. 4. In some embodiments, the tab 43 has an attached pad or coating of elastomeric material for providing compliant engagement with the lower cross-brace 24 and frictional grip to hold the stools 11, 13, 15, 17 in the retracted-storage position. In some embodiments, the seats 30 of the stools 11, 13, 15, 17 are arranged substantially within a perimeter of the table top 14 in the retracted-storage position. In some embodiments, the seats 30 of the stools 11, 13, 15, 17 extend outward of the perimeter of the table top 14 in the retracted-storage position, but less than in the extended-use position. The seats 30 of the stools 11, 13, 15, 17 are moved outward (e.g., away from the table top 14) and downward (e.g., toward the surface G) relative to the frame 12 from the retracted-storage position to the extended-use position of the stools 11, 13, 15, 17 by way of the hinges 40 as suggested in FIGS. 4 and 5. The seats 30 of the stools 11, 13, 15, 17 are moved upward (e.g., away from the surface G) and inward (e.g., toward the table top 14) relative to the frame 12 from the extended-use position to the retracted-storage position of the stools 11, 13, 15, 17.

The seats 30 of the stools 11, 13, 15, 17 are arranged at a first height $H_1$ relative to the surface G under the table 10 in the retracted-storage position as illustrated by stool 13 in FIG. 6. This raised height $H_1$ allows access under the table 10 for relocation of the table 10 and cleaning under the table 10, among other benefits contemplated by the present disclosure. The seats 30 of the stools 11, 13, 15, 17 are arranged at a second height $H_2$ relative to the surface G in the extended-use position as illustrated by stool 13 in FIG. 7. The seats 30 are movable relative to the hinges 40 in response to a user sitting on the seats 30 as suggested by stool 11 in FIG. 7. The seat 30 engages with the surface G to support the user relative to the table top 14. The gas cylinder 34 returns the seat 30 to the second height $H_2$ in response to the user standing up off of the seat 30.

The above description in relation to stools 11, 13, and any components thereof, applies equally to stools 15, 17.

Another embodiment of a table 210 in accordance with the present disclosure is shown in FIGS. 9 and 10. The table 210 is similar to the table 10 shown in FIGS. 1-8, with at least one difference being that the table 210 includes six stools 211, 213, 215, 217, 218, 219. Similar reference numerals in the 200's are used in FIGS. 9 and 10 to identify similar components to those of the table 10 shown in FIGS. 1-8. The stools 211, 213, 215, 217, 218, 219 are similar to the stools 11, 13, 15, 17, including the structures and operation thereof as described herein. In the illustrative embodiment, the stool 218 is coupled to leg 223 of frame 212, and the stool 219 is coupled leg 227 as shown in FIGS. 9 and 10. In some embodiments, the stool 218 is coupled to leg 225 of frame 212, and the stool 219 is coupled leg 221.

The table 10 includes four stools 11, 13, 15, 17, and the table 210 includes six stools 211, 213, 215, 217, 218, 219. In some embodiments, more or less stools can be used without departing from the present disclosure. The exemplary tables 10, 210 assume rectangular shapes, but can assume other polygonal or non-polygonal shapes without departing from the present disclosure. The exemplary frames 12, 212 of the tables 10, 210, respectively, assume rectangular shapes, but can assume other polygonal or non-polygonal shapes without departing from the present disclosure.

The embodiment(s) detailed hereinabove may be combined in full or in part, with any alternative embodiment(s) described.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

While the present disclosure describes various exemplary embodiments, the disclosure is not so limited. To the contrary, the disclosure is intended to cover various modifications, uses, adaptations, and equivalent arrangements based on the principles disclosed. Further, this disclosure is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims.

The invention claimed is:

1. A table comprising:

a frame having a leg and a cross-brace coupled to the leg;

a table top coupled to the frame for supporting the table top above a surface; and a stool coupled to the frame for movement relative to the frame between a retracted-storage position and an extended-use position, the stool having a hinge and a seat, a first end of the hinge coupled to the leg of the frame and the seat coupled to a second end of the hinge spaced apart from the first end, the hinge configured to allow movement of the seat relative to the frame, and the seat configured for movement relative to the hinge toward and away from the surface, wherein the stool is arranged at a first height above the surface in the retracted-storage position and the stool is arranged at a second height above the surface in the extended-use position, the second height is less than the first height, and the stool is configured to engage with the cross-brace to support the stool in the retracted-storage position.

2. The table of claim 1, wherein, in the extended-use position, the seat is configured to engage with the surface in response to a user sitting on the seat to support the user relative to the table top.

3. The table of claim 1, wherein the hinge includes a base tube arranged at the first end of the hinge, a swing tube arranged at the second end of the hinge, and an arm coupled between the base tube and the swing tube, wherein the seat extends into the swing tube, and wherein the base tube is coupled to the leg and configured to allow pivoting and sliding movement of the hinge relative to the frame.

4. The table of claim 3, further comprising a shaft extending through the base tube and coupled to the leg to support the hinge on the frame.

5. The table of claim 4, wherein the base tube is configured to pivot around the shaft and to slide along the shaft.

6. The table of claim 3, further comprising a biasing element coupled to the seat and the hinge, wherein the seat is configured to slide along the swing tube of the hinge, and wherein the biasing element is configured to bias the seat away from the surface.

7. The table of claim 6, wherein the biasing element is a gas cylinder.

8. A table comprising:

a frame having a plurality of legs and a cross-brace coupled to the plurality of legs;

a table top coupled to the frame for supporting the table top above a surface; and a plurality of stools coupled to the plurality of legs of the frame, each stool of the plurality of stools configured for movement relative to the frame between a retracted-storage position and an extended-use position, each stool of the plurality of stools having a hinge and a seat, a first end of the hinge coupled to one of the legs of the plurality of legs and the seat coupled to a second end of the hinge spaced apart from the first end, the hinge configured to allow movement of the seat relative to the frame, and the seat configured for movement relative to the hinge toward and away from the surface, wherein the plurality of stools are arranged at a first height above the surface in the retracted-storage position and the plurality of stools are arranged at a second height above the surface in the extended-use position, the second height is less than the first height, and the stools are configured to engage with the cross-brace to support the corresponding stool of the plurality of stool in the retracted-storage position.

9. The table of claim 8, wherein, in the extended-use position, the seat is configured to engage with the surface in response to a user sitting on the seat to support the user relative to the table top.

10. The table of claim 8, wherein each hinge includes a base tube arranged at the first end of the hinge, a swing tube arranged at the second end of the hinge, and an arm coupled between the base tube and the swing tube, wherein the seats extend into the swing tubes, and wherein the base tubes are coupled to the plurality of legs and configured to allow pivoting and sliding movement of the hinges relative to the frame.

11. The table of claim 10, further comprising shafts extending through the base tubes and coupled to the plurality of legs to support the hinges on the frame.

12. The table of claim 11, wherein the base tube is configured to pivot around the shaft and to slide along the shaft.

13. The table of claim 10, further comprising biasing elements coupled to the seats and the hinges, wherein the seats are configured to slide along the swing tubes of the respective hinges, and wherein the biasing elements are configured to bias the seats away from the surface.

14. The table of claim 13, wherein each biasing element is a gas cylinder.

15. The table of claim 8, wherein at least two stools of the plurality of stools are coupled to the same leg of the plurality of legs.

* * * * *